US005720064A

United States Patent [19]

Koo

[11] Patent Number: 5,720,064

[45] Date of Patent: Feb. 24, 1998

[54] WASHING MACHINE WATER LEVEL DETECTING METHOD USING WEIGHT SENSOR

[75] Inventor: Bonkwon Koo, Seoul, Rep. of Korea

[73] Assignee: LG Electronics, Inc., Seoul, Rep. of Korea

[21] Appl. No.: 748,594

[22] Filed: Nov. 13, 1996

[30] Foreign Application Priority Data

Nov. 18, 1995 [KR] Rep. of Korea ..... 42123/1995

[51] Int. Cl.[6] ..... D06F 33/02; D06F 39/08

[52] U.S. Cl. ..... 8/158; 68/12.04; 68/12.05; 68/207

[58] Field of Search ..... 8/158; 68/12.04, 68/12.05, 207

[56] References Cited

U.S. PATENT DOCUMENTS 4,303,406 12/1981 Ross ..... 68/12.05 X 4,862,710 9/1989 Torita et al. ..... 68/12.04 X 5,042,276 8/1991 Kamano et al. ..... 68/12.04

5,271,116 12/1993 Williams et al. ..... 68/12.05 X 5,606,877 3/1997 Hashimoto ..... 68/12.04

5,634,227 6/1997 Lim ..... 68/12.05 X

*Primary Examiner*—Philip R. Coe

*Attorney, Agent, or Firm*—Ostrolenk, Faber, Gerb & Soffen, LLP

[57] ABSTRACT

A washing machine water level detecting method using a weight sensor for supplying water up to the decided water supply level and performing a next cycle if the determined water supply level is below the predetermined level, or measuring a displacement in accordance with water supply per unit and storing the measured displacement data in a microcomputer if the determined water supply level is above the predetermined level. The method enables an accurate detection of the water level in a washing machine without requiring an additional sensor.

3 Claims, 4 Drawing Sheets

[kHz]

| | 1ST | 2ND | 3RD | 4TH | 5TH | AVERAGE | REMARKS |
|---|---|---|---|---|---|---|---|
| 0 ℓ (ND LOAD) | 11235 | 11345 | 11235 | 11370 | 11340 | 11305 | OVER 58 ℓ EXCEEDS SENSOR CAPACITY AND THUS NOT SUITABLE AS MEASURED DATA |
| 18 ℓ | 13245 | 13715 | 13500 | 13535 | 13400 | 13479 | |
| 28 ℓ | 15875 | 16160 | 16020 | 16635 | 16200 | 16179 | |
| 38 ℓ | 21590 | 21260 | 20810 | 21890 | 21370 | 21384 | |
| 48 ℓ | 26640 | 26940 | 26390 | 26810 | 26600 | 26676 | |
| 58 ℓ | 28030 | 28050 | 28030 | 28035 | 28050 | 28039 | |

WASHING MACHINE WATER LEVEL DETECTING METHOD USING WEIGHT SENSOR

BACKGROUND OF THE INVENTION

1. Field of the Invention

The present invention relates to a water level detecting method of a washing machine, and more particularly to a washing machine water level detecting method using a weight sensor capable of accurately detecting the water level irrespective of a sensing zone of a water level detecting sensor.

2. Description of the Prior Art

With reference to a conventional washing machine as shown in FIG. 1, at a lower side portion in a tub 1 these is provided an air chamber 2, at an upper portion of which these is formed an opening which communicates through a hose 3 to a water level sensor 4. In a position of a bottom surface of the tub 1 there is provided a drain pipe 5 connected to a drain hose 6 by a drain valve 7, so that the water in the tub 1 can be sequentially discharged through the drain pipe 5 and the drain hose 6 in accordance with the operation of a drain motor 8.

The operation of the thusly composed conventional washing machine will now be described.

First, the water supplied into the tub 1 during a washing cycle or a rinsing cycle compresses the air in the air chamber 2, and the compressed air is in turn delivered to the water level sensor 4.

The compressed air serves to change the displacement of the coil mounted in the water level sensor 4. The variation of the coil displacement denotes the variation of a reactance value, so that the value of frequency is varied which is oscillated by the coil and condenser, whereby a frequency variant value in accordance with the water level variation is incorporated into a table to accordingly detect the water level.

When water is supplied up to a predetermined level in the tub 1 in accordance with a predetermined frequency value, the water supply is paused to thereby carry out a washing cycle or a rinsing cycle.

Subsequently, when the washing or rinsing cycle is completed after a predetermined time of operation, the drain valve 7 is adjusted by the drain motor 8 to thereby discharge the used water sequentially through the drain pipe 5 and the drain hose 6.

However, in the water level detecting method of the conventional washing machine, a water level detecting range is confined to a predetermined water level, thereby causing difficulty in detecting the amount of water reaching above the predetermined level.

SUMMARY OF THE INVENTION

Accordingly, it is an object of the present invention to provide a washing machine water level detecting method using a weight sensor for accurately detecting the water level irrespective of a sensing zone of a water level detecting sensor.

To achieve the above-described object, the washing machine water level detecting method using a weight sensor for detecting an input laundry amount and a water level of a washing tub therein to thereby correspond to the input laundry amount in accordance with a displacement measured by an input laundry weight and a water supply applied to the input laundry weight includes the steps of: detecting the weight of laundry put into a washing tub provided in the washing machine and deciding a corresponding water supply level in the washing tub; judging whether the decided water supply level is below a predetermined level; supplying water up to the decided water supply level and performing a next cycle if the decided water supply level is below the predetermined level, or measuring a displacement in accordance with water supply per unit and storing the measured displacement data in a microcomputer if the decided water supply level is above the predetermined level; comparing the stored displacement data with a present displacement data to thereby obtain a per-unit water supply time; and calculating an entire water supply time in accordance with the obtained per-unit water supply time and the decided water supply level, and supplying water for the calculated entire water supply time and performing the next cycle.

DETAILED DESCRIPTION OF THE PRESENT INVENTION

Figure 1:
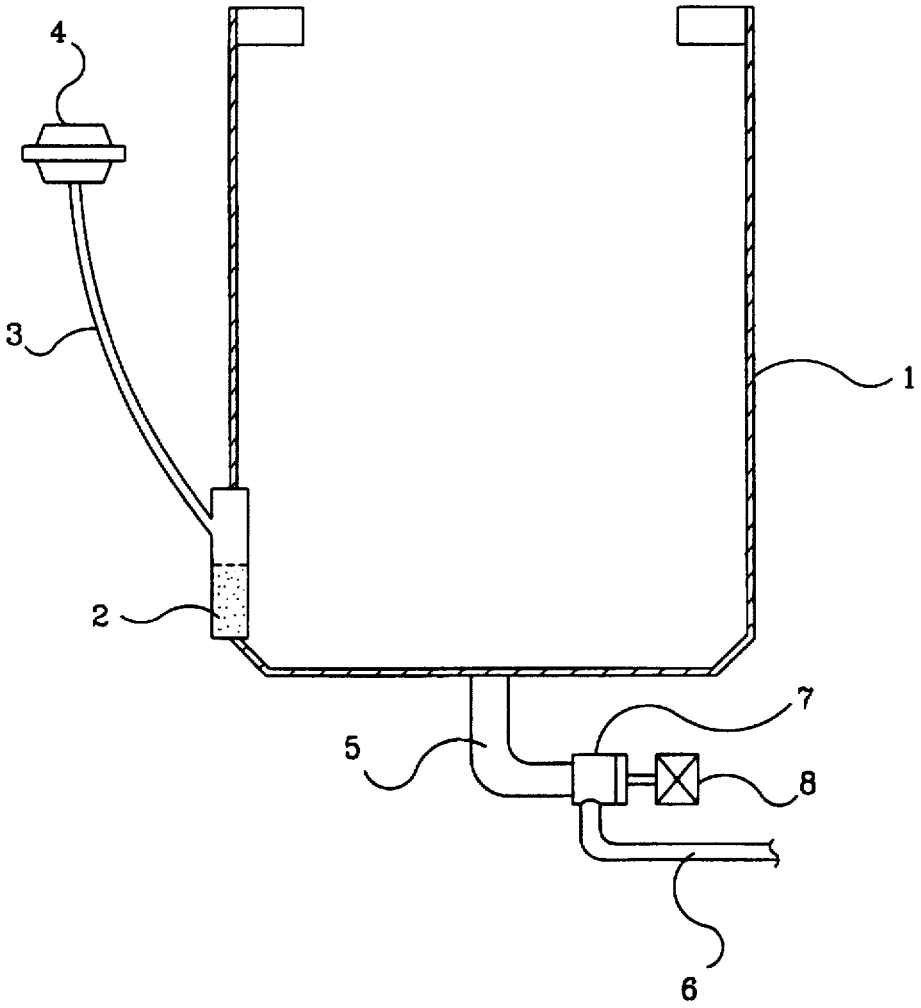
FIG. 1 CONVENTIONAL ART
FIG. 1 is a structural view of a conventional washing machine.
Figure 2:
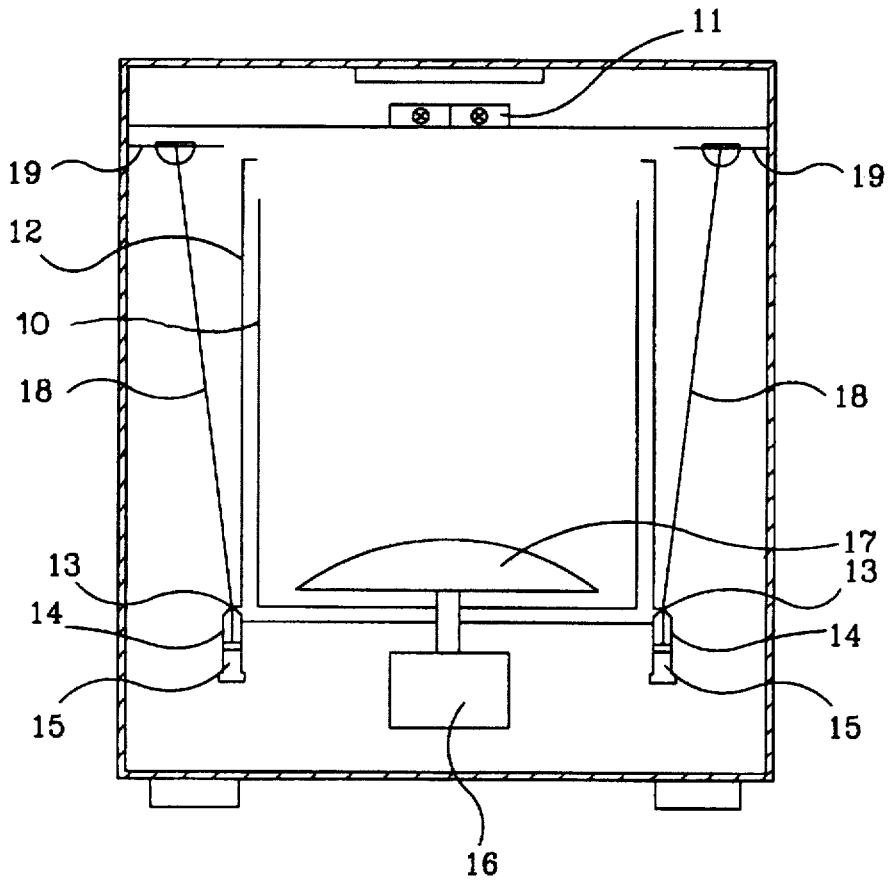
FIG. 2 is a structural view of a washing machine according to the present invention.

As shown in FIG. 2, the washing machine according to the present invention includes: an inner tub 10 for washing laundry using water supplied therein; a conduit 11 for supplying water into the inner tub 10 therethrough; an outer tub 12 which is lowered in accordance with the weight of laundry and water introduced into the inner tub 10; a damper cap 14 which is compressed by a lower plate 13 when the outer tub 12 is lowered; and a weight sensor 15 for sensing the weight of laundry using a relative displacement of an elastic member functioning due to compression of the damper cap 14. Here, reference numeral 16, denotes a motor, reference numeral 17 denotes a pulsator, reference numeral 18 denotes a snubber bar, and reference numeral 19 denotes a damper assembly.

The operation of the thusly composed washing machine according to the present invention will now be described.

First, when laundry is put into the inner tub 10, the outer tub 12 is lowered due to the weight of the laundry to thus cause the lower plate 13 to press the damper cap 14, which in turn compresses the elastic member and is lowered in a direction that is parallel with the snubber bar 18. A coil bobbin (not shown) and a coil each fixed around the damper cap 14 are also lowered toward the snubber bar 18.

At this time, a core fixed around the snubber bar 18 and the damper cap 14 move between pits of a fixed coil to generate a relative displacement which leads to a frequency variation or a voltage variation.

Therefore, in accordance with the relative displacement the weight of the laundry is detected, and the appropriate water level is determined accordingly.

In order to more accurately detect the water level, water instead of laundry is put into the inner tub 10 to measure a displacement in frequency of voltage in accordance with the following method.

Figures 3, 4:
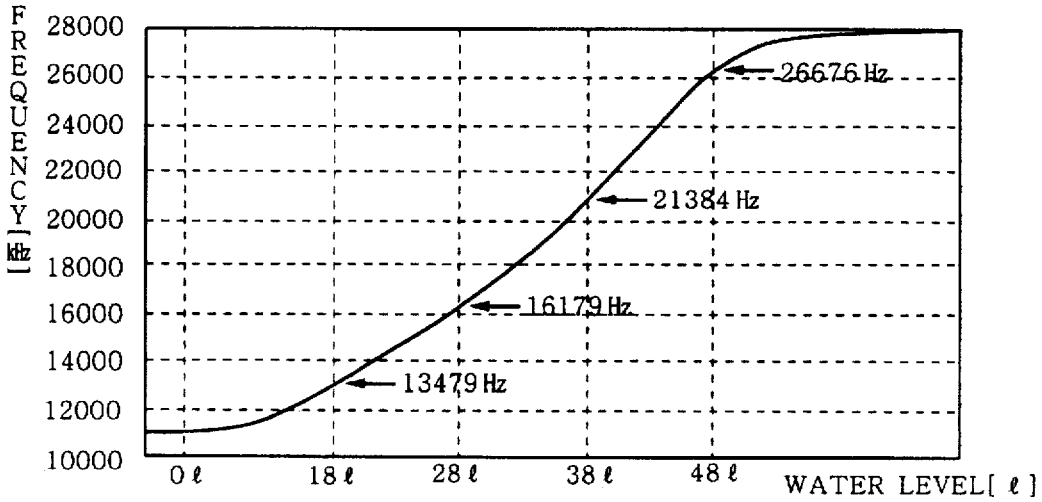
FIG. 3 is a graph showing the change in frequency characteristics as water level increases.
FIG. 4 is a table showing measured frequency values in accordance with a weight increase of laundry.

FIG. 3 shows a graph of frequency values measured in accordance with an increase of water supply, wherein when water supply exceeds 48 l the frequency displacement remains constant so that the weight of the water cannot be measured.

Therefore, as shown in FIG. 4, an average value is initially obtained by measuring frequency for a certain number of times while increasing water supply by 10 l. At this time, the frequencies are not measured if the water supplied into the inner tub 10 exceeds 58 l which is outside the capacity of the sensor, or if less than 18 l of water is in the tub 10 because such small amount is not enough to cause the outer tub 12 to be displaced. Then, the time required for the water supply to reach a certain level is measured as water supply is increased by 10 l from 18 l until 48l is reached.

when water pressure remains steady, the measured time for supplying 28 l, 38 l, and 48 l of water is identical, and the time required to supply such amounts of water is slightly different only when these exists a difference in water pressure.

To compensate for the time difference which occurs due to different water pressure, the time required for supplying 10 l is measured by averaging the time values measured at 28 l, 38 l, and 48 l, and the resultant data is stored in a microcomputer (not shown). That is, when laundry is put into the inner tub 10, the weight sensor 15 detects the laundry amount and determines a corresponding water level to thereby supply water to the determined water supply level.

when the then detected weight requires the water level to be below a predetermined level, a washing and rinsing cycle is carried out after supplying water up to the predetermined level instead of calculating the time required for supplying water.

when the detected weight requires more than a predetermined water level, an appropriate amount of water is supplied by calculating a total water supply time T in accordance with the following expression (1).

$$\text{Total Supply Time } T=(T1*T3)+(T2*\text{Laundry Weight})+(T4*T2) \quad (1)$$

T1: time required to supply 10 l;

T2: time required to supply 1 l;

T3: quotient of (Target Water Supply—48)/10;

T4: remainder of (Target Water Supply—48)/10.

In the expression (1), since a single digit calculation amplifies an error value, a 10 l supply time is calculated differently from a 1 l supply time, and to minimize the error value a 10 l-unit is employed. Also, the term of (T2*Laundry Weight) is added to compensate for the laundry amount to thereby more accurately detect the laundry weight.

Figure 5:
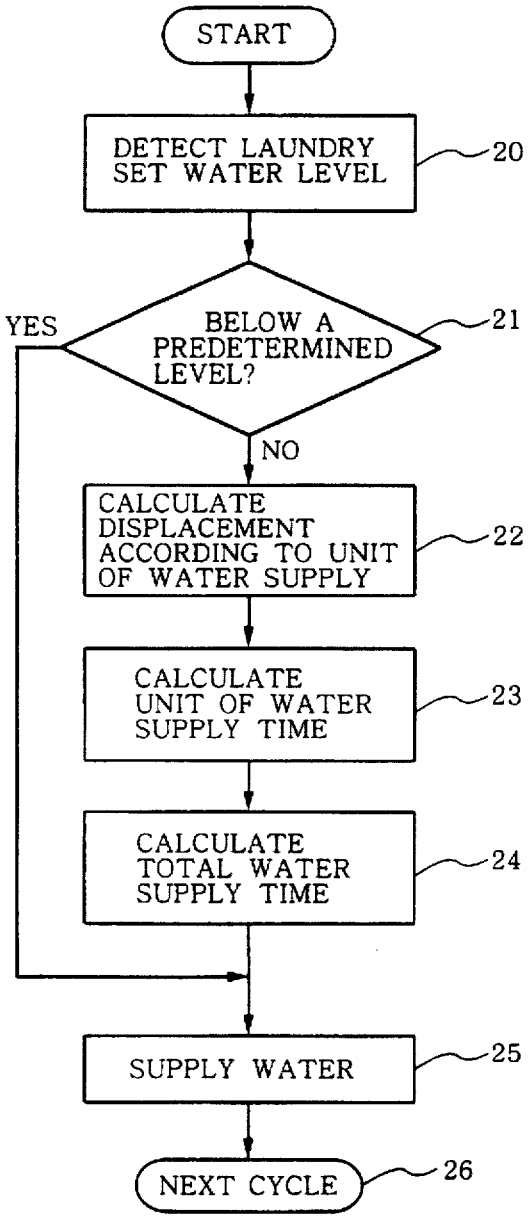
FIG. 5 is a flow chart in accordance with a water level detecting method of the washing machine in FIG. 2.

Subsequently, when a total supply time T is obtained, water is supplied until the obtained time value is reached to thereby proceed to a next cycle.

with reference to the flow chart in FIG. 5, the washing or rinsing steps according to the present invention will now be explained.

Initially, the weight of laundry put into the washing tub 10 provided in the washing machine is detected and an appropriate water supply level in the washing tub is determined (20).

Then, by judging (21) whether the determined water supply level is below a predetermined level, water is supplied up to the determined water supply level and the next cycle is performed if the determined water supply level is below the predetermined level, or a displacement is measured (22) in accordance with water supply per unit and the measured displacement data is stored in a microcomputer if the determined water supply level is above the predetermined level.

The stored displacement data is compared with a present displacement data to thereby obtain a per-unit water supply time T1, T2 (23), and a total water supply time T is calculated (24) in accordance with the obtained per-unit water supply time T1, T2 and the determined water supply level.

Water is supplied (25) for the calculated entire waters supply time and the next cycle is carried out (26).

As described above, the present invention determines a water supply level in the washing tub by sensing the weight of laundry, and when the determined water level is below a predetermined level, water is supplied regardless of a water supply time, but when above the predetermined level, a total water supply time is calculated using a displacement of frequency or voltage in accordance with a per-unit water supply.

Conclusively, the present invention results in an accurate detection of the water level irrespective of a sensing zone of a water level detecting sensor although these is provided a small sensing zone of the installed sensor.

What is claimed is:

1. A washing machine water level detecting method using a weight sensor for detecting an amount of laundry and a level of water in a washing tub in accordance with a displacement measured from the weight of laundry and the amount of water supplied to the laundry, comprising the steps of:

detecting the weight of a laundry put into the washing tub provided in the washing machine and determining a corresponding water supply level in the washing tub;

judging whether the determined water supply level is below a predetermined level;

supplying water up to the determined water supply level and performing a next cycle if the determined water supply level is below a predetermined level, of measuring a displacement in accordance with water supply per unit and storing the measured displacement data in a microcomputer if the determined water supply level is above the predetermined level;

comparing the stored displacement data with a present displacement data to these by obtain a per-unit water supply time, and calculating an entire water supply time in accordance with the obtained per-unit water supply time and the determined water supply level; and supplying water for the calculated entire water supply time and performing a next cycle of operation.

2. The method of claim 1, wherein one unit of water supply is 10 l.

3. The method of claim 1, wherein the entire water supply is obtained by an expression of (T1* T3)+(T2* Laundry Weight)+(T4* T2), wherein T1: water supply per 10 l; T2: time supply time per 1 l; T3: quotient of (Target Water Supply—48)/10; and T4: remainder of (Target Water Supply—48)/10.

* * * * *